US006377516B1

(12) United States Patent
Whiteside et al.

(10) Patent No.: US 6,377,516 B1
(45) Date of Patent: Apr. 23, 2002

(54) ULTRASONIC TRANSDUCER WITH LOW CAVITATION

(75) Inventors: John Whiteside, Lenexa; Craig Mehan, Overland Park, both of KS (US)

(73) Assignee: Garmin Corporation, Taipei (TW)

( * ) Notice: Subject to any disclaimer, the term of this patent is extended or adjusted under 35 U.S.C. 154(b) by 0 days.

(21) Appl. No.: 09/733,137

(22) Filed: Dec. 8, 2000

(51) Int. Cl.[7] ..... H04R 1/44
(52) U.S. Cl. ..... 367/173; 367/910
(58) Field of Search ..... 367/173, 165, 367/910, 188

(56) References Cited

U.S. PATENT DOCUMENTS

| | | | | |
|---|---|---|---|---|
| 2,672,945 A | | 3/1954 | Harris et al. | |
| 3,563,335 A | * | 2/1971 | Holmes | 367/173 |
| 3,753,219 A | * | 8/1973 | King, Jr. | 367/173 |
| 4,555,938 A | | 12/1985 | Boucher et al. | |
| 4,644,787 A | | 2/1987 | Boucher et al. | |
| 4,907,208 A | | 3/1990 | Lowrance et al. | |
| 5,109,364 A | | 4/1992 | Stiner | |
| 5,142,497 A | * | 8/1992 | Warrow | 367/173 |
| 5,379,658 A | * | 1/1995 | Lichenfels , II et al. | 73/644 |
| 5,719,824 A | * | 2/1998 | Boucher | 367/176 |

* cited by examiner

*Primary Examiner*—Ian J. Lobo
(74) *Attorney, Agent, or Firm*—Hovey Williams LLP

(57) ABSTRACT

An ultrasonic sonar transducer (10) for attachment to a water vessel that more effectively transmits and receives sonar signals even when the water vessel is traveling at high speeds. The sonar transducer includes a transducer element (12) and a transducer housing (14) for housing the transducer element. The transducer housing includes a lower housing section (22) having a bottom wall (34) that is continuously curved with no major portion thereof parallel to the bottom face of the transducer element. The curved bottom is preferably bow-shaped so that the front of the transducer housing is raised relative to the rear to create a positive angle of attack relative to the oncoming water. This pressurizes water flow under the bottom of the transducer housing and promotes a laminar flow. Such a laminar flow reduces turbulence and cavitation and therefore nearly eliminates undesirable attenuation and reflection of transmitted and received energy. Although the transducer housing bottom is curved, the bottom face of the transducer element remains parallel to the surface of the water so that sonar is transmitted and received perpendicular to the surface of the water.

24 Claims, 2 Drawing Sheets

ULTRASONIC TRANSDUCER WITH LOW CAVITATION

BACKGROUND OF THE INVENTION

1. Field of the Invention

The present invention relates to sonar transducers. More particularly, the invention relates to an ultrasonic sonar transducer that more effectively transmits and receives sonar signals even when the water vessel to which it is attached is traveling at high speeds.

2. Description of the Prior Art

Sonar transducers are commonly used in depth finder and fish finder systems for determining the depth of a body of water or for locating underwater objects such as fish and fish beds. Sonar transducers are typically either integrally formed as a part of a water vessel hull or mounted behind the water vessel by suitable brackets.

Sonar transducers that are configured for attachment to a water vessel typically include a transducer element for transmitting and receiving acoustic energy (sonar) and a transducer housing for enclosing or housing the transducer element. To provide optimal performance, it is important that transducer housings be mounted so that they are at least partially underwater so that the sonar is delivered from the transducer element directly into the water without first passing through the air above the water. However, those skilled in the art will appreciate that such underwater mounting causes undesired turbulence and cavitation, especially when the water vessel to which the sonar transducer is attached is traveling at high speeds. Turbulence and cavitation in turn cause attenuation and reflection of the transmitted and received acoustic energy and thus interfere with operation of the sonar transducers.

These turbulence and cavitation problems are exasperated by known prior art sonar transducer designs which have transducer housings with flat bottoms. Flat bottoms create excessive turbulence and cavitation and therefore cause signal attenuation and reflection as described above. Prior art sonar transducers also typically have sharp corners that further lead to additional undesired turbulence and cavitation. To reduce cavitation in these types of prior art sonar transducers, it is known to mount the transducer housings at a slight positive angle of attack (i.e. the front of the housings raised) relative to the oncoming water. This is partially effective at reducing turbulence and cavitation, but the angling of the transducer housings also angles the transducer elements contained in the housings so that the transducer elements are no longer parallel to the surface of the water. This causes the transmitted and received acoustic energy to travel at angles relative to the surface of the water and therefore distorts target images and reduces the accuracy of depth measurements.

SUMMARY OF THE INVENTION

The present invention solves the above-described problems and provides a distinct advance in the art of sonar transducers. More particularly, the present invention provides a sonar transducer that more effectively transmits and receives sonar signals even when the water vessel to which it is attached is traveling at high speeds.

In one preferred embodiment of the invention, the sonar transducer includes a transducer element and a transducer housing for housing the transducer element. The transducer housing includes a lower housing section having a bottom wall that is continuously curved with no major portion thereof parallel to the bottom face of the transducer element. The curved bottom is preferably bow-shaped so that the front of the transducer housing is raised relative to the rear to create a positive angle of attack relative to the oncoming water. This pressurizes water flow under the bottom of the transducer housing and promotes a laminar flow. Such a laminar flow reduces turbulence and cavitation and therefore nearly eliminates undesirable attenuation and reflection of transmitted and received energy. Although the transducer housing bottom is curved, the bottom face of the transducer element remains parallel to the surface of the water so that sonar is transmitted and received perpendicular to the surface of the water.

In another embodiment of the present invention, the transducer housing includes an acoustic window aligned with the bottom face of the transducer element for passing acoustic energy into and out of the transducer housing. The acoustic window is preferably formed from a combination of a recessed portion in the bottom wall and potting material positioned between the bottom face of the transducer element and the recessed portion.

The recessed portion of the bottom wall and the potting are preferably formed of material having a specific gravity approximately equal to the specific gravity of water. The combined thickness of the recessed portion and the potting material is preferably approximately equal to one half of the wavelength or an integer multiple of one half of the wavelength of the acoustic energy transmitted by the transducer element. The combination of these two factors makes the acoustic window nearly transparent to the acoustic energy transmitted from the transducer element.

These and other important aspects of the present invention are described more fully in the detailed description below.

BRIEF DESCRIPTION OF THE DRAWING FIGURES

A preferred embodiment of the present invention is described in detail below with reference to the attached drawing figures, wherein.

Figure 3:
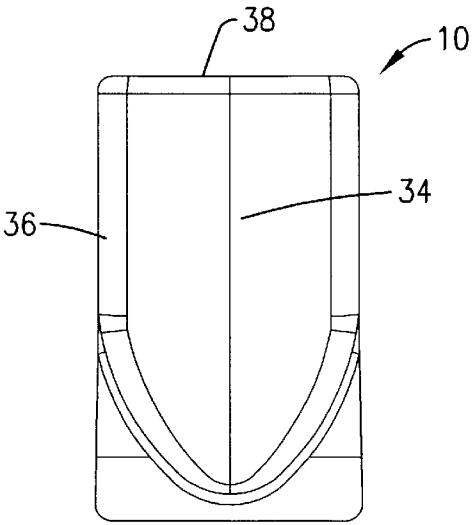
FIG. 3 is a bottom view of the sonar transducer.
Figure 2:
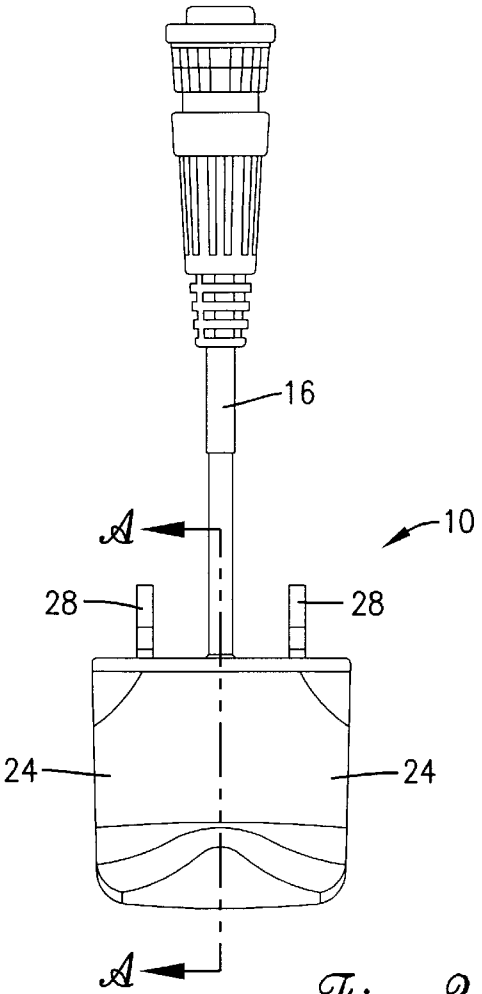
FIG. 2 is a front elevation view of the sonar transducer.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

Figure 1:
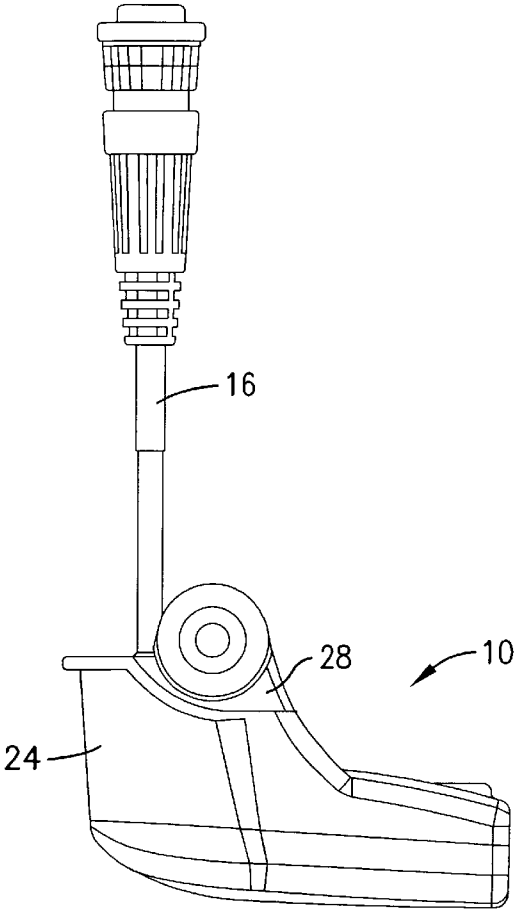
FIG. 1 is a side elevation view of a sonar transducer constructed in accordance with a preferred embodiment of the present invention.
Figure 4:
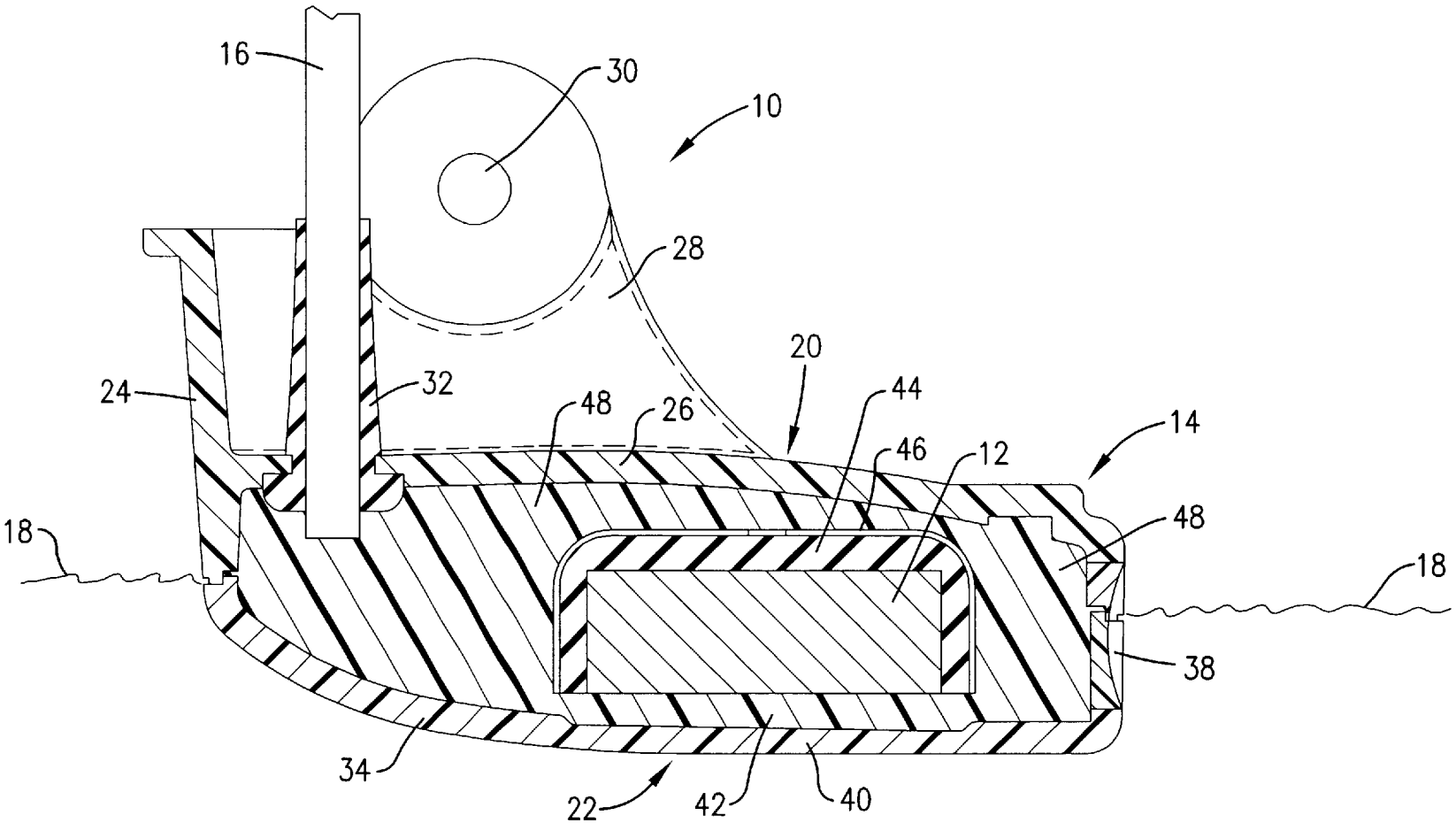
FIG. 4 is a vertical section view of the sonar transducer taken along line A—A of FIG. 2.

Turning now to the drawing figures, and particularly FIG. 1, a sonar transducer 10 constructed in accordance with a preferred embodiment of the invention is illustrated. The sonar transducer 10 is configured for mounting to a water vessel such as a boat and may be used in a depth finder and/or fish finder system for determining the depth of a body of water or for locating underwater objects such as fish or fish beds. Referring to FIG. 4, the preferred sonar transducer 10 broadly includes a transducer element 12 for transmitting acoustic energy (sonar) into and receiving acoustic energy from a body of water and a transducer housing 14 for housing and enclosing the transducer element 12.

In more detail, the transducer element 12 is entirely conventional and is preferably in the shape of a right, circular cylinder. The transducer element transmits and receives acoustic energy in a conventional manner and is coupled with an electronic control unit or processor of a depth finder and/or fish finder system by an electrical cord 16. The transducer element 12 presents a top face, a bottom face, and a circular sidewall. As depicted in FIG. 4 and as described in more detail below, the sonar transducer 10 is configured so that the bottom face of the transducer element 12 is substantially parallel to the surface 18 of a body of water.

The transducer housing 14 preferably includes an upper housing section 20 and a lower housing section 22 that connect together to enclose and seal the transducer element 12 from exposure to water and other contaminants. The upper and lower housing section 20, 22 are both preferably injection molded of synthetic resin materials.

The upper housing section 20 includes a generally vertically extending front and side walls 24 that are bow-like in shape and a slightly curved but generally horizontally extending top wall 26. The upper housing section 20 also preferably includes an integrally attached mounting stem 28. A horizontally-extending bore or hole 30 is formed in the top of the mounting stem 28 for receiving a screw or shaft for attaching the transducer housing 14 to a mounting assembly (not shown). The mounting assembly is in turn attached to the transom or other part of a water vessel. The upper housing section 20 also includes an opening for receiving the electrical cord 16. The opening is preferably sealed with a flexible grommett 32.

The lower housing section 22 includes a bottom wall 34 a circumventing sidewall 36, and a rear wall 38. The bottom wall 34 has a continuously curving shape with rounded corners that merge with the sidewall 36. The bottom wall and the sidewall together form a bow-shaped front end that has no sharp transitions in shape. The bottom wall preferably slopes down from front to back in a curved shape of a fourth order spline. The intersection of the bottom wall 34 with the side wall 36 and end wall 38 section is rounded with a radius of 4.5 millimeters or greater so that the upward flow of water traveling from the bottom wall and around the sidewall also creates a laminar flow.

As described in more detail below, the transducer housing 14 is attached to a boat or other water vessel so that the bottom face of the transducer element 12 is substantially parallel to the surface 18 of the water. The front, bow-shaped portion of the lower housing section is raised relative to the rear of the lower housing section to create a slight positive angle of attack relative to the oncoming water.

The above-described construction, shape and mounting of the lower housing section 22 slightly pressurizes the water flow under the bottom wall 34 to promote a laminar flow. This reduces turbulence and cavitation and therefore nearly eliminates attenuation and reflection of acoustic energy. Thus, the sonar transducer 10 of the present invention is more effective at transmitting and receiving acoustic energy than known prior art sonar transducers even when the water vessel to which it is attached is traveling at high speeds.

The lower housing section 22 bottom wall 34 also includes a reduced-thickness recessed portion 40 that is in alignment with the bottom face of the transducer element 12. The material in the recessed portion and the potting preferably has a specific gravity approximately equal to the specific gravity of water. A layer of potting material 42 is positioned between the recessed portion 40 and the bottom face of the transducer element. The recessed portion 40 and the layer of potting material 42 together form an acoustic window that aids in the transmission of acoustic energy from and the receipt of acoustic energy into the transducer element 12. The combined thickness of the recessed portion and the potting material is preferably approximately one half the wavelength or an integer multiple of one half the wavelength of the acoustic energy that is transmitted from the transducer element 12.

Acoustic energy is reduced somewhat by the natural impedance of the acoustic window and also by any destructive interference caused by reflection off of a density change boundary. By forming the recessed portion 40 and potting 42 of materials that have a specific gravity close to water, the effect of sound reflection from a density change boundary is diminished. Further, by designing the total thickness of the acoustic window to be approximately one half of a wavelength or an integer multiple of one half of a wavelength of the acoustic energy traveling through the acoustic window, any acoustic energy that is reflected reaches the face of the transducer element at the start of the next cycle. In other words, in-phase. The effect of the careful selection of the recessed portion 40 and potting 42 material and the careful design of the total thickness of the acoustic window makes the acoustic window nearly transparent to acoustic energy transmitted from and received by the transducer element 12.

To diminish the effect of stray sonar signals, the top face and sides of the transducer element 12 are enclosed with a layer of closed cell foam baffle material 44 such as neoprene. The baffle layer 44 isolates the transducer element from transmitting or receiving acoustic energy from the sides and top of the element. The preferred baffle layer is relatively soft and has a durometer rating of 50–75 on the Shore A scale.

To reduce electrostatic and electromagnetic interference, the transducer element 12 and the baffle layer 44 are covered on the top and sides with an electrostatic shield 46 preferably made of a highly conductive material such as tin plated cold rolled steel. Electrical leads from the cable 16 are attached to the top and bottom electrodes of the transducer element 12 and a shield in the cable is connected to the electrostatic shield layer. The transducer element 12, baffle layer 44, and electrostatic shield 46 are then preferably encapsulated with potting material 48 such polyurethane to provide a water tight seal entirely around the transducer element.

In use, the sonar transducer 10 is mounted to the transom or other portion of a water vessel such as a boat by connecting the mounting stem 28 to a mounting assembly which is then attached to the water vessel. The sonar transducer is preferably mounted so that the lower housing section 22 is slightly underwater and the bottom face of the transducer element 12 is parallel to the surface 18 of the water. As the water vessel to which the sonar transducer is attached begins to move, water flows under the bottom wall 34 of the transducer housing 14. This pressurizes the water to promote a laminar flow. The laminar flow reduces turbulence and cavitation and therefore eliminates attenuation and reflection of transmitted and received acoustic energy from the transducer element, even when the water vessel is traveling at high speeds.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A sonar transducer for attachment to a water vessel, the sonar transducer comprising:

a transducer element operable for transmitting acoustic energy into and receiving acoustic energy from a body of water, the transducer element presenting a bottom face; and a transducer housing for housing the transducer element, the transducer housing including a lower housing section having a bottom wall that is continuously curved with no major portion thereof parallel to the bottom face of the transducer element, wherein the bottom wall substantially continuously slopes down from a front end to a back end so that the front end is raised relative to the back end.

2. The sonar transducer as set forth in claim 1, the lower housing section also having side walls that curve into the bottom wall.

3. The sonar transducer as set forth in claim 1, wherein the bottom wall and the side walls of the lower housing section converge to form a substantially continuously arcuate front end that has no sharp transitions.

4. The sonar transducer as set forth in claim 1, the transducer housing further including an upper housing section that connects with the lower housing section.

5. The sonar transducer as set forth in claim 4, the transducer housing further including a mounting stem integrally formed with the upper housing section for attaching the sonar transducer to the water vessel.

6. The sonar transducer as set forth in claim 1, the bottom wall having a recessed portion that partially forms an acoustic window aligned with the bottom face of the transducer element for transmitting the acoustic energy from the transducer element out of the transducer housing and for receiving the acoustic energy back into the transducer housing.

7. A sonar transducer for attachment to a water vessel, the sonar transducer comprising:

a transducer element operable for transmitting acoustic energy into and receiving acoustic energy from a body of water, the transducer element presenting a bottom face; and a transducer housing for housing the transducer element, the transducer housing including a lower housing section, the lower housing section including a bottom wall having a recessed portion that partially forms an acoustic window aligned with the bottom face of the transducer element for transmitting the acoustic energy from the transducer element out of the transducer housing and for receiving the acoustic energy back into the transducer housing, wherein the bottom wall substantially continuously slopes down from a front end to a back end so that the front end is raised relative to the back end.

8. The sonar transducer set forth in claim 7, the acoustic window further being formed by potting material positioned between the bottom face of the transducer element and the recessed portion of the bottom wall.

9. The sonar transducer set forth in claim 8, the recessed portion and the potting material being formed of material having a specific gravity approximately equal to a specific gravity of water.

10. The sonar transducer as set forth in claim 7, wherein the acoustic energy is of a selected wavelength, the acoustic window having a thickness approximately equal to one half of the wavelength or an integer multiple of one half of the wavelength.

11. The sonar transducer as set forth in claim 7, wherein the bottom wall is continuously curved with no major portion thereof parallel to the bottom face of the transducer element.

12. The sonar transducer as set forth in claim 7, the lower housing section also having side walls that curve into the bottom wall.

13. The sonar transducer as set forth in claim 7, wherein the bottom wall and the side walls of the lower housing section converge to form a substantially continuously arcuate front end that has no sharp transitions.

14. The sonar transducer as set forth in claim 7, the transducer housing further including an upper housing section that connects with the lower housing section.

15. The sonar transducer as set forth in claim 14, the transducer housing further including a mounting stem integrally formed with the upper housing section for attaching the sonar transducer to the water vessel.

16. A sonar transducer for attachment to a water vessel, the sonar transducer comprising:

a transducer element operable for transmitting acoustic energy into and receiving acoustic energy from a body of water, the transducer element presenting a bottom face; and a transducer housing for housing the transducer element, the transducer housing including a lower housing section having a bottom wall that is continuously curved with no major portion thereof parallel to the bottom face of the transducer element, the bottom wall having a recessed portion that partially forms an acoustic window aligned with the bottom face of the transducer element for transmitting the acoustic energy from the transducer element out of the transducer housing and for receiving the acoustic energy back into the transducer housing, wherein the acoustic energy is of a selected wavelength, the acoustic window having a thickness approximately equal to one half of the wavelength or an integer multiple of one half of the wavelength and the bottom wall substantially continuously slopes down from a front end to a back end so that the front end is raised relative to the back end to create a slightly pressurized water flow under the bottom wall until oncoming water has reached the back end of the transducer housing, and an upper housing section that connects with the lower housing section.

17. A sonar transducer for attachment to a water vessel, the sonar transducer comprising:

a transducer element operable for transmitting acoustic energy into and receiving acoustic energy from a body of water, the transducer element presenting a bottom face; and a transducer housing for housing the transducer element, the transducer housing including a lower housing section having a bottom wall, wherein the bottom wall substantially continuously slopes down from a front end to a back end so that the front end is raised relative to the back end to create a slightly pressurized water flow under the bottom wall until oncoming water has reached the back end of the transducer housing.

18. The sonar transducer as set forth in claim 17, the lower housing section also having side walls that curve into the bottom wall.

19. The sonar transducer as set forth in claim 17, the transducer housing further including an upper housing section that connects with the lower housing section.

20. The sonar transducer as set forth in claim 19, the transducer housing further including a mounting stem integrally formed with the upper housing section for attaching the sonar transducer to the water vessel.

21. The sonar transducer as set forth in claim 17, the bottom wall having a recessed portion that partially forms an acoustic window aligned with the bottom face of the transducer element for transmitting the acoustic energy from the transducer element out of the transducer housing and for receiving the acoustic energy back into the transducer housing.

22. The sonar transducer set forth in claim 1, wherein the bottom wall creates a slightly pressurized water flow under the bottom wall until oncoming water has reached the back end of the transducer housing.

23. The sonar transducer set forth in claim 7, wherein the bottom wall creates a slightly pressurized water flow under the bottom wall until oncoming water has reached the back end of the transducer housing.

24. A sonar transducer for attachment to a water vessel, the sonar transducer comprising:

a transducer element operable for transmitting acoustic energy of a selected wavelength into and receiving acoustic energy of the wavelength from a body of water, the transducer element presenting a bottom face; and a transducer housing for housing the transducer element, the transducer housing including a lower housing section having a bottom wall with a recessed portion that partially forms an acoustic window having a thickness approximately equal to one half of the wavelength or an integer multiple of one half of the wavelength, wherein the bottom wall is continuously curved with no major portion thereof parallel to the bottom face of the transducer element and substantially continuously slopes down from a front end to a back end so that the front end is raised relative to the back end to create a slightly pressurized water flow under the bottom wall until oncoming water has reached the back end of the transducer housing.

* * * * *